US006137981A

United States Patent [19]

Janssens et al.

[11] Patent Number: 6,137,981

[45] Date of Patent: Oct. 24, 2000

[54] APPARATUS FOR FORMING MULTIPLE TONER IMAGES IN REGISTER WITH EACH OTHER ON A SUBSTRATE

[75] Inventors: Robert Frans Louisa Janssens, Geel; Luc Karel Maria Van Aken, Hasselt, both of Belgium

[73] Assignee: Xeikon NV, Mortsel, Belgium

[21] Appl. No.: 09/337,656

[22] Filed: Jun. 22, 1999

[30] Foreign Application Priority Data

Jul. 14, 1998 [EP] European Pat. Off. ..... 98305582

[51] Int. Cl.[7] ..... G03G 15/01; G03G 15/00

[52] U.S. Cl. ..... 399/301; 347/116; 399/160; 399/162; 399/394

[58] Field of Search ..... 399/301, 298, 399/38, 160, 162, 167, 43, 306, 364, 394; 347/115, 116

[56] References Cited

U.S. PATENT DOCUMENTS

| | | | |
|---|---|---|---|
| 4,251,154 | 2/1981 | Russel . | |
| 4,751,549 | 6/1988 | Koizumi . | |
| 5,101,232 | 3/1992 | Evans et al. | 399/160 |
| 5,173,733 | 12/1992 | Green | 399/160 X |
| 5,235,392 | 8/1993 | Hediger | 347/116 X |
| 5,848,339 | 12/1998 | Costrop et al. | 399/298 |

FOREIGN PATENT DOCUMENTS

| | | |
|---|---|---|
| 0 079 222 | 5/1983 | European Pat. Off. . |
| 62-290374 | 12/1987 | Japan . |
| 04340563 | 11/1992 | Japan . |
| WO 98/07072 | 2/1998 | WIPO . |
| WO 98/07073 | 2/1998 | WIPO . |

*Primary Examiner*—Sophia S. Chen
*Attorney, Agent, or Firm*—Larson & Taylor PLC

[57] ABSTRACT

The apparatus includes an endless belt, an imaging station, a number of developing stations, and a number of transfer stations. A controllable belt drive drives the endless belt along a path through the imaging station, the developing stations and the transfer stations. A preformed timing mark is carried on the belt and a sensor is provided for sensing the passage of the timing mark past a sensing position. A control device controls the belt drive to run at a constant speed and controls the speed of the belt in response to the sensing of the timing mark. The maintenance of a constant belt speed can be more reliably assured.

14 Claims, 3 Drawing Sheets

APPARATUS FOR FORMING MULTIPLE TONER IMAGES IN REGISTER WITH EACH OTHER ON A SUBSTRATE

FIELD OF THE INVENTION

The present invention relates to an image-forming apparatus for forming multiple toner images in register with each other on a substrate in sheet form and to a method of operating an image-forming apparatus to form multiple toner images in register with each other on a substrate in sheet form.

BACKGROUND TO THE INVENTION

Image-forming apparatus, such as copiers and printers, are known for forming multiple toner images in register with each other on a substrate in sheet form. Each such toner image is referred to herein as a "color plane". Such an apparatus may include an endless belt and a number of processing stations arranged along its path. These stations may include an imaging station at which a plurality of electrostatic images are sequentially formed on the belt. At a number of developing stations, the electrostatic images are developed into toner images on the belt. The toner images are then transferred to a substrate at a number of transfer stations. The endless belt is driven along a belt path through the imaging station, the developing stations and the transfer stations by a belt drive device. By use of a substrate drive device, the substrate is driven along a substrate path into contact with the endless belt at the transfer stations.

For example, U.S. Pat. No. 4,751.549 (Koizumi/Ricoh Company Ltd) describes a color copying machine for forming multiple toner images in register with each other on a substrate in sheet form. The apparatus comprises an endless belt, an imaging station at which a plurality of electrostatic images are sequentially formed on the belt, a plurality of developing stations at which the electrostatic images are developed into toner images on the belt, a plurality of transfer stations at which the toner images are transferred to a substrate, and a substrate drive device for driving the substrate along a substrate path into contact with the endless belt at the transfer stations.

In such an apparatus, it is important to the quality of the printed image, to maintain the photoconductive belt at a constant speed. The speed of the belt is a very important parameter in controlling the length of the distinct color planes written on the belt and transferred to the substrate as well as in the registration accuracy of the transfer of succeeding color planes to the substrate in different transfer stations. While a drive motor provided to drive the belt drive roller may be controlled in a known manner to run at a constant speed, any variation in the path followed by the belt will result in variations in the belt speed at the image exposure station and at the image transfer stations. Such variations in belt path can be caused by non-perfectly circular guide rollers.

Image forming apparatus which are designed to make two images in one pass on each side of the receiving substrate (so-called simultaneous duplex engines), may consist of two imaging systems as described above with two endless belts. In such apparatus the image receiving substrate is transferred from the first imaging system to the second imaging system and consequently it is very important that both image forming members in the succeeding transfer stations are running at the same speed.

For example, International patent specifications Wo 98/07073 and WO 98/07072 (Agfa-Gevaert NV) describe a duplex image-forming apparatus for forming multiple toner images in register with each other on a substrate in sheet form. The apparatus comprises a first endless belt, a first imaging station at which a plurality of first electrostatic images are sequentially formed on the first belt, a plurality of first developing stations at which the first electrostatic images are developed into first toner images on the first belt, a plurality of first transfer stations at which the first toner images are transferred to a substrate in sheet form, and a first belt drive device for driving the first endless belt along a first belt path through the first imaging station, the first developing stations and the first transfer stations. The apparatus also comprises a second endless belt, a second imaging station at which a plurality of second electrostatic images are sequentially formed on the second belt, a plurality of second developing stations at which the second electrostatic images are developed into second toner images on the second belt, a plurality of transfer stations at which the toner images are transferred to the substrate, a second belt drive device for driving the second endless belt along a second belt path through the second imaging station, the second developing stations and the second transfer stations; and a substrate drive device for driving the substrate along a substrate path into contact with the first endless belt at the initial one of the first transfer stations and the second transfer stations.

It is an object of the present invention to provide an image forming apparatus of the type described above in which the maintenance of a constant belt speed can be more reliably assured.

SUMMARY OF THE INVENTION

We have now discovered that this objective, and other useful advantages, can be achieved when the apparatus includes a preformed timing mark carried on the belt, together with a sensor for sensing the passage of the timing mark past a sensing position; and a control device for controlling the belt drive device to run at a constant speed and to control the speed of the belt in response to the sensing of the timing mark.

Thus, according to a first aspect of the invention, there is provided an image-forming apparatus for forming multiple toner images in register with each other on a substrate in sheet form, the apparatus comprising:

an endless belt;

an imaging station at which a plurality of electrostatic images are sequentially formed on the belt;

a plurality of developing stations at which the electrostatic images are developed into toner images on the belt;

a plurality of transfer stations at which the toner images are transferred to a substrate;

a belt drive device for driving the endless belt along a belt path through the imaging station, the developing stations and the transfer stations; and a control device for controlling the belt drive device to run at a constant speed, characterized by:

a preformed timing mark carried on the belt; and a sensor for sensing the passage of the timing mark past a sensing position, the control device being adapted to control the speed of the belt in response to the sensing of the timing mark.

According to a second aspect of the invention, there is provided a method of operating an image-forming apparatus to form multiple toner images in register with each other on a substrate in sheet form, the method comprising driving an endless belt along a belt path through an imaging station, a plurality of developing stations and a plurality of transfer stations, sequentially forming a plurality of electrostatic images on the belt at the imaging station, controlling a belt drive device for said belt to run at a constant speed while the electrostatic images are being formed on the belt at the imaging station, developing the electrostatic images into toner images on the belt at the plurality of developing stations, and transferring the toner images to the substrate at the plurality of transfer stations, characterized by sensing a preformed timing mark carried on the belt, as the timing mark passes a sensing position, and controlling the speed of the belt in response to the sensing of the timing mark.

The apparatus preferably also includes a substrate drive device for driving the substrate along a substrate path into synchronous contact with the endless belt at the initial one of the transfer stations, the control device being adapted to control the speed of the substrate through the transfer stations in response to the sensing of the timing mark. The method preferably therefore further includes driving a substrate in sheet form along a substrate path into synchronous contact with the endless belt at the transfer stations, and controlling the speed of the substrate through the transfer stations in response to the sensing of the timing mark.

The belt may include a transverse seam, in which case the timing mark is preferably located at a predetermined position relative to the seam, for example at the same position as the seam, or close thereto. In order to avoid that the transverse seam will be positioned in one of the electrostatic images, the belt may be nominally divided into a plurality of regions, the seam being positioned between two adjacent regions, wherein the formation of the plurality of electrostatic images is so controlled as to locate each color plane of the color image in a respective region of the belt. In this case each of such regions of the belt has a length D, where $$L=nD$$

where n is an integer and L is the total length of the endless belt. The length D is chosen such that it is slightly larger than the maximum expected length of the color plane in order to allow for the transverse seam to be positioned between two successive color planes and to allow for switching of the dark potential on the belt, switching of color stations and switching of transfer stations between two successive color planes.

The difference between the spacing between two adjacent transfer stations, $\Delta T$, as measured along the belt path, and the spacing between two adjacent transfer stations, $\Delta S$, as measured along the substrate path, should be equal to the distance (D) between the succeeding color planes on the belt, that is:

$$D=\Delta T-\Delta S.$$

This is necessary in order to position the succeeding color images on top of each other on the image receiving substrate with no registration error.

Each roller over which the endless belt passes, preferably has a circumference which is an integral fraction of the distance (D) between the succeeding color planes on the belt.

Also, the spacing ($\Delta S$) between two adjacent transfer stations, as measured along the substrate path is preferably an integral fraction of the distance (D) between the succeeding color planes on the belt. By this arrangement, any deviation in the circularity of any guiding roller, especially of the transfer rollers, leads to the same deviations in the belt path and consequently to the same belt speed variations for each color plane. As a consequence, these belt speed variations do not cause registration errors.

The speed of the belt is measured by measuring the time period between two successive passages of the timing mark past a sensing position. This revolution time measurement can be converted into a very accurate measure of the average speed of the belt (length of the belt divided by the revolution time) since time can be measured very accurately (accuracy of a piezo crystal; better than 0.001%) and the length of the belt is known very accurately (±0.2 mm on a length of about 4000 mm, or ±0.05%).

The drive motor provided to drive the belt may be controlled with a standard feedback loop using a rotary encoder on the shaft of the drive motor.

The measurement of the revolution time is compared with a target value and can be used to correct the set value of the feedback loop if necessary. This correction can be made at the start-up of the printer to correct for systematic errors only. Alternatively, or additionally, this correction can be made after predetermined periods of run time to correct for drifting errors, such as temperature drift. Alternatively, or additionally, this correction can be made after each revolution of the belt, in which case the correction is made at the moment that the transition of two adjacent regions on the belt passes the exposure unit, so that no image exposure is in progress during correction of the belt speed. The value of the correction is chosen to be so small that the resulting change in the speed of the belt is not visible in the image development and image transfer. In order to achieve this, the belt drive device is capable of driving the belt at a constant speed while image exposure is in progress.

We are aware of a number of a number of documents describing the possible use of timing marks for controlling the operation of an image forming apparatus. For example, European patent specification EP 79222-A (Xerox Corporation) describes a copying apparatus and method of copy sheet registration. A moving substrate is brought into contact with a moving photoreceptor belt carrying an image for transfer to the substrate. Timing marks are placed xerographically on the belt at the time of image formation on the belt. The belt is driven at a constant speed and the speed of the substrate is adjusted in response to the sensing of the timing marks.

In the apparatus and method according to the present invention however, it is important that the timing mark on the belt is preformed, i.e. it is not printed onto the belt along with the images. Printing of marks along with the image, as described in EP 79222, enables the speed of the belt to be measured only if the marks can be applied at a known distance from each other, independent of the speed of the belt. This can only be done if the marks are projected onto the belt simultaneously at a fixed known distance. If this is not possible, as is the case with digital line by line exposure, the marks only allow the position of the image to be detected if the marks are applied at a fixed position relative to the image.

The timing mark may be in the form of a discontinuity in the belt, such as a hole therethrough. Alternatively the mark may be formed as a discrete region of differential reflectivity, such as a black non-reflective mark or an evaporated gold or silver reflective mark. The timing mark is suitably provided during fabrication of the belt. Preferably, only one timing mark is provided, thereby enabling the revolution time of the belt to be directly determined.

We are also aware of U.S. Pat. No. 4,251,154 (Matthew J Russel/Eastman Kodak Company) which describes a simplex electrophotographic color copier in which a movable photoconductive web, adapted to receive images in non-overlapping image areas, is moved along a transport path into contact with a moving substrate in sheet form. The web includes timing marks or regularly spaced perforations which are sensed by a timing signal generator to produce timing signals, which are fed to a microcomputer. Timing of actuation of the sheet feeder is controlled in response to the timing signals, to ensure accurate registration.

Japanese patent publication JP 4340563 (Konica Corp) describes a color image forming device in which a mark is put on a specified spot of a photosensitive belt, a mark sensor is provided for detecting the mark and the time required for one rotation of the belt is measured according to a mark detection signal from the mark sensor. The scanning speed of an exposing beam is then adjusted so that the scanning time interval is 1/n of the time required for one rotation, where n is an integer. Thereby the deviation of the writing position is said to be accurately corrected.

Japanese patent publication JP 62290374 (Ricoh Co Ltd) describes a motor controller in which marks are attached at predetermined intervals to the peripheral side edge of a transfer belt passing over a drive roller. A DC servo motor for driving the drive roller is controlled in response to the output signal of mark reading means disposed under the belt.

The apparatus according to the invention may be adapted for duplex printing, that is for forming multiple toner images in register with each other on both faces of a substrate. Thus, the apparatus may comprise:

- a first endless belt;
- a first imaging station at which a plurality of first electrostatic images are sequentially formed on the first belt;
- a plurality of first developing stations at which the first electrostatic images are developed into first toner images on the first belt;
- a plurality of first transfer stations at which the first toner images are transferred to a substrate in sheet form;
- a first belt drive device for driving the first endless belt along a first belt path through the first imaging station, the first developing stations and the first transfer stations;
- a second endless belt;
- a second imaging station at which a plurality of second electrostatic images are sequentially formed on the second belt;
- a plurality of second developing stations at which the second electrostatic images are developed into second toner images on the second belt;
- a plurality of transfer stations at which the toner images are transferred to the substrate;
- a second belt drive device for driving the second endless belt along a second belt path through the second imaging station, the second developing stations and the second transfer stations; and
- a control device for controlling the first belt drive device and the second belt drive device each to run at a constant speed, characterized by:

- a preformed timing mark carried on the first belt; and
- a sensor for sensing the passage of the timing mark past a sensing position,
- the control device being adapted to control the speed of the first and second belts in response to the sensing of the timing mark.

Preferably, a preformed timing mark is carried on both belts, sensors are provided for sensing the passage of the timing marks past a sensing position for both belts, and the control device controls the speed of both the first and second belts in response to the sensing of both timing marks.

A duplex apparatus will normally also include a substrate drive device for driving the substrate along a substrate path into synchronous contact with the first endless belt at the initial one of the first transfer stations and the second transfer stations, the control device being adapted to control the speed of the substrate through the first and second transfer stations in response to the sensing of the timing mark.

Since the substrate is transported by both belts during the time period in which the substrate is electrostatically in contact with both belts, the speeds of both belts should be the same to avoid smearing of the transferred images due to slipping of the substrate on one or both belts. The speed of the first belt is controlled in the manner as described above. The speed of the second belt is controlled in almost the same way, except that the target speed of the second belt is adapted after each revolution and set to the measured average speed of the first belt. This master-slave concept makes the speed difference between the belts virtually equal to zero.

BRIEF DESCRIPTION OF THE DRAWING

The invention will be described in further detail, purely by way of example, with reference to the accompanying drawings, in which.

DETAILED DESCRIPTION

Figure 1:
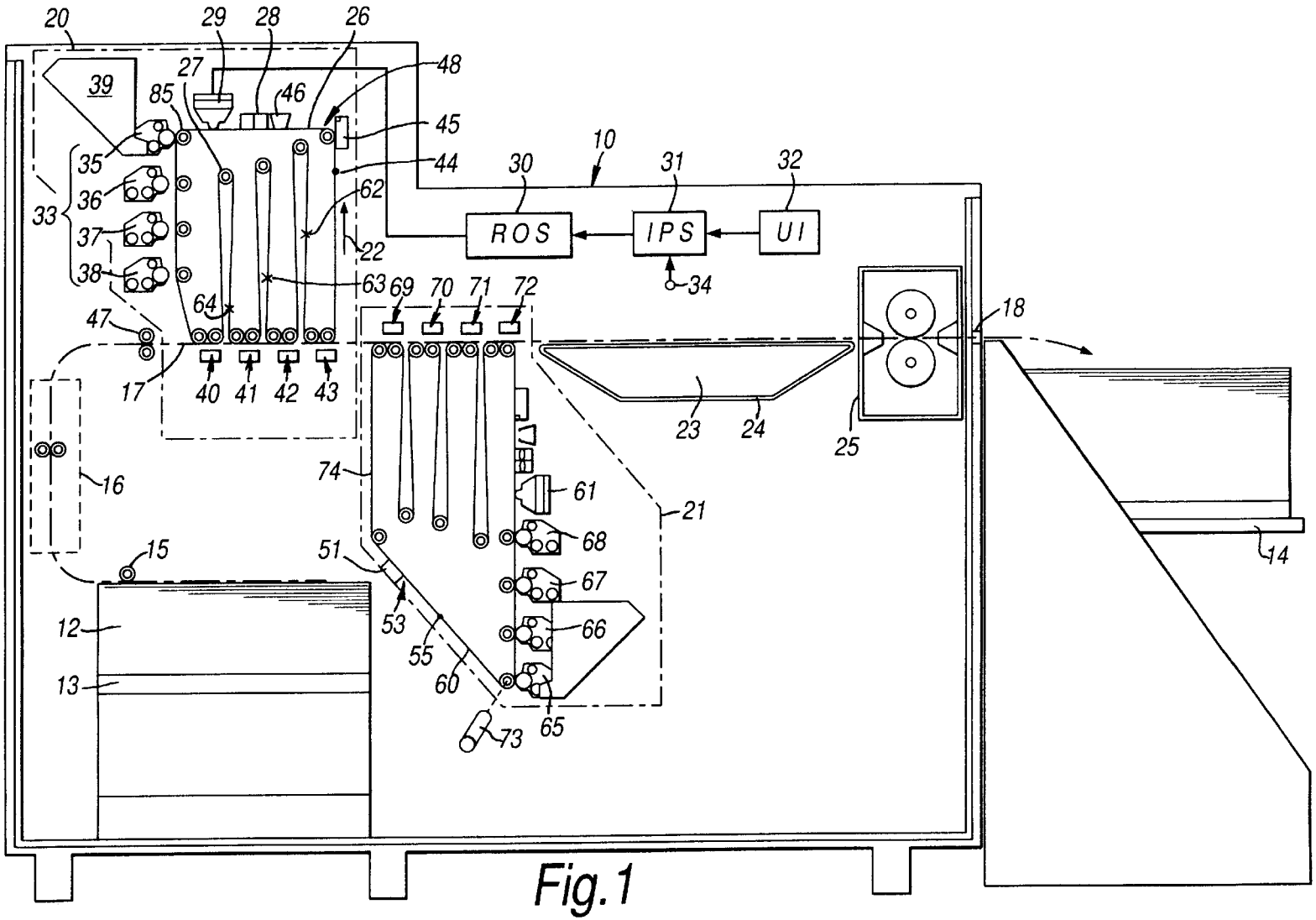
FIG. 1 shows a diagrammatic representation of one embodiment of an electrophotographic duplex color printer.

The image-forming apparatus shown in the drawings is in the form of a printer adapted for duplex printing, that is for forming multiple toner images in register with each other on both faces of a substrate in sheet form. The drawings are diagrammatic representations of one embodiment of an electrophotographic duplex color printer.

The printer comprises a light-tight housing 10 which has at its inside a stack 12 of sheets to be printed and loaded on a platform 13. The height of this platform 13 is adjusted in accordance with the size of the stack 12. At its output the printer has a platform 14 onto which the printed sheets are received.

A sheet to be printed is removed from stack 12 by a dispensing mechanism 15 of known construction for removing the top sheet from stack 12.

The removed sheet is fed through an alignment station 16 which ensures the longitudinal and lateral alignment of the sheet, prior to its start from said station under the control of the image-forming system. As the sheet leaves the alignment station, it follows a straight horizontal path 17 up to output section 18 of the printer. The speed of the sheet, upon entering said path, is determined by driven pressure roller pair 47, driven by a controllable stepper motor 76, the frequency of which is adjustable with an accuracy of a piezo crystal (i.e. better than 0.001%).

Once the paper is electrostatically attached to the first belt 26 at the initial transfer station 40, the pressure roller pair 47 is released and, from this point on, the sheet is only transported by the electrostatic forces in the subsequent transfer stations.

A number of processing stations are located along the path 17. A first image-forming section 20 indicated in a dash-and-dot line is provided for applying a multi-color image to the obverse side of the sheet and is followed by a second section 21 for applying a multi-color image to the reverse sheet side. A buffer station 23 then follows, with an endless transport belt 24 for transporting the sheet to a fuser station 25 while allowing the speed of the sheet to decrease because the speed of fuser 25 is lower than the speed of image formation.

Referring to the first image-forming station, an endless photoconductor belt 26 is guided over a plurality of guide rollers 27 to follow a belt path 58 in the direction of arrow 22 to advance successive portions of the photoconductive surface sequentially through the various processing stations disposed about the belt path 58.

The endless photoconductor belt 26 is driven by a drive roller 85, driven with a controllable DC-motor 56 associated with an encoder 57. The signals generated by the encoder 57 are fed to a control device 50, such as a micro-processor. The motor 56 is coupled to the drive roller 85 over a two-step reduction with a total reduction of 1/25.

A device (not shown) is provided controlling the lateral position of the endless photoconductor belt 26.

The endless photoconductor belt may comprise a base layer of polyethyleneterephthalate of 100 μm thickness covered with a thin layer of aluminum as a back electrode (less than 0.5 μm thickness). The organic photoconductor (OPC) layer is on top of the aluminum layer and is from 15 μm in thickness. To make contact with the aluminum back electrode, the photoconductor has two strips of carbon/polymer mixture, with a width of 10 mm, positioned beyond the image area and extending through the OPC layer. Conductive grounding brushes (not shown) contact these carbon strips. The endless photoconductor belt is arranged such that the photoconductive layer is positioned on the outside of the endless photoconductor belt loop.

Initially, a portion of endless photoconductor belt 26 passes through charging station 28. At the charging station, a corona-generating device electrostatically charges the photoconductor belt to a relatively high, substantially uniform potential, the dark potential. Next, the endless photoconductor belt passes to a digital line by line exposure station 29. The exposure station includes a raster output scanner (ROS) 30 including a laser with a rotating polygonal mirror block which creates the output printing image by laying out the image in a series of horizontal scan lines, with a scan line frequency of, for example, 7 KHz. Exposure station 29 will expose the endless photoconductor belt to successively record four latent color separation images.

Figure 3:
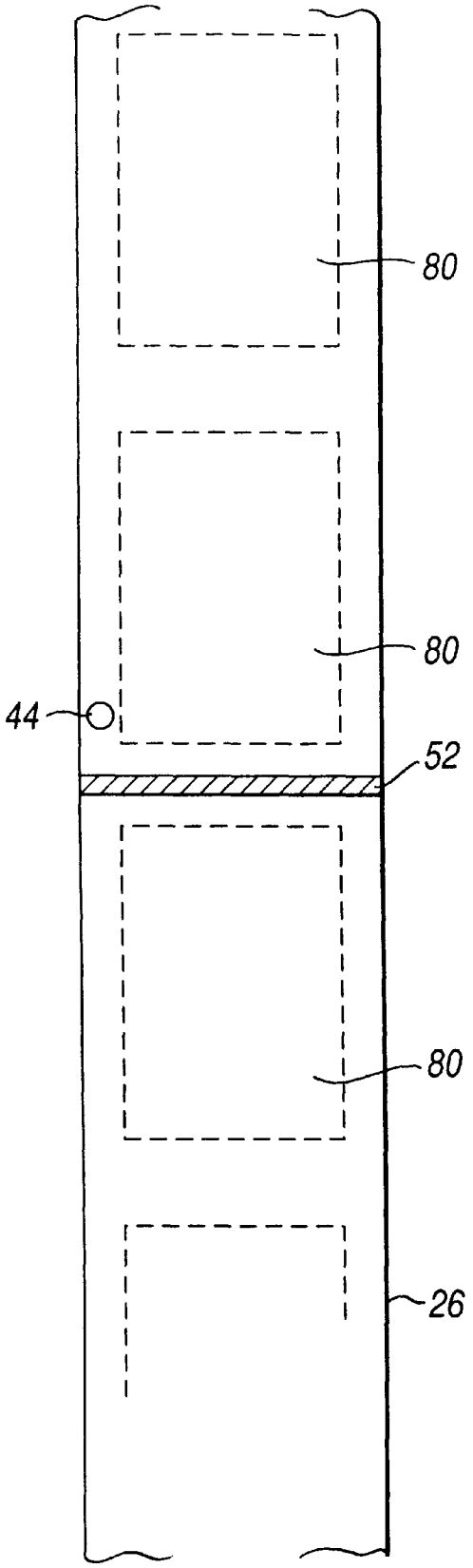
FIG. 3 shows a portion of one of the photoconductive belts used in the printer shown in FIG. 1.

As shown in more detail in FIG. 3, the endless photoconductor belt 26 includes a transverse seam 52. The endless photoconductor belt 26 is nominally divided into seven regions 80, the seam 52 being positioned between two adjacent regions 80. The formation of the four electrostatic images, or "color planes" is so controlled as to locate each electrostatic image in a respective region 80 of the endless photoconductor belt 26. Where, for example, the belt 26 has a length (L) of 3,820.742 mm±0.2 mm, the distance (D) between two successive planes is 1/7 of the total length of the endless belt, i.e. 545.82 mm. The circumference of the belt drive roller 85 and of the belt tensioning roller is 1/4 of the distance between successive color planes, i.e. 136.46 mm. The circumference of the other belt guiding rollers is 1/7 of the distance between successive color planes, i.e. 77.97 mm. The spacing (ΔS) between two adjacent transfer stations as measured along the substrate path, is 1/7 of the distance between successive color planes, i.e. 77.97 mm.

The latent images are developed for example with magenta, cyan, yellow and black developer material, respectively. These developed images are transferred to the print sheet in superimposed registration with one another to form a multicolor image on the sheet. The ROS receives its input signal from an image processing system (IPS) 31. This system is an electronic control device which prepares and manages the data inflow to the scanner 30. A user interface (UI) 32 is in communication with the IPS and enables the operator to control various operator-adjustable functions. IPS 31 receives its signal from input 34. This input can be the output of a raster input scanner (RIS), in which case the apparatus is a so-called intelligent copier. In such case, the apparatus contains document illumination lamps, optics, a mechanical scanning drive, and a charge-coupled device. The RIS captures the entire original document and converts it to a series of raster scan lines and measures a set of primary color densities, i.e. red, green and blue densities at each point of the original document. However, input 34 can as well receive an image signal resulting from an operator operating an image processing station.

After an electrostatic latent image has been recorded on the endless photoconductor belt 26, the belt 26 advances this image to the development station 33 which includes four individually selectable developing units 35, 36, 37 and 38.

Figure 2:
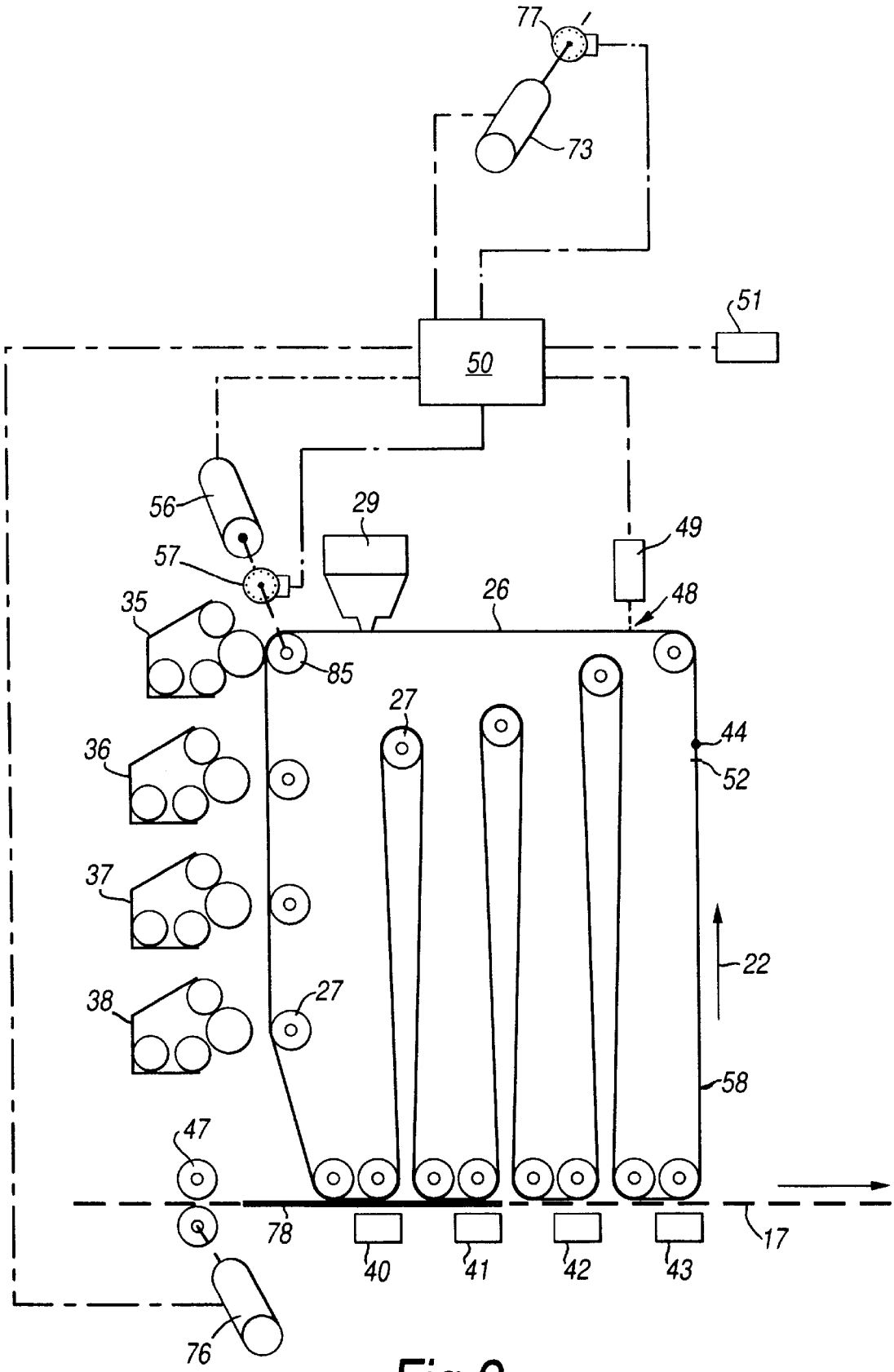
FIG. 2 shows an enlarged portion of part of FIG. 1, with some components removed for the sake of clarity.

The developing units are of a type generally referred to in the art as "magnetic brush development units". Developing units 35, 36 and 37, respectively, apply toner particles of a specific color which corresponds to the compliment of the specific color-separated electrostatic latent image recorded on the photoconductive surface. The color of each of the toner particles is adapted to absorb light within a preselected spectral region of the electromagnetic wave spectrum. For example, an electrostatic latent image formed by discharging the portions of charge on the endless photoconductor belt corresponding to the green regions of the original document will record the red and blue portions as areas of relatively high charge density on endless photoconductor belt 26, while the green areas will be reduced to a voltage level ineffective for development. The charged areas are then made visible by having developing unit 35 apply green absorbing (magenta) toner particles onto the electrostatic latent image recorded on photoconductor belt 26. Similarly, a blue separation is developed by developing unit 36 with blue absorbing (yellow) toner particles, while the red separation is developed by developing unit 37 with red absorbing (cyan) toner particles. Developing unit 38 contains black toner particles and may be used to develop the electrostatic latent image formed from black information or text, or to supplement the color developments. Each of the developing units is movable into and out of an operative position. In the operative position, the magnetic brush is closely adjacent to the photoconductor belt, whereas in the non-operative position, the magnetic brush is spaced therefrom. During development of each electrostatic latent image only one developing unit is in the operative position, the remaining developing units being in their non-operative one. This ensures that each electrostatic latent image is developed with toner particles of the appropriate color without intermingling. In FIGS. 1 and 2, developing unit 35 is shown in its operative position. Finally, each unit comprises a toner hopper, such as hopper 39 shown for unit 35, for supplying fresh toner to the developer which becomes progressively depleted by the development of the electrostatic charge images.

After their development, the toner images are moved to toner image transfer stations 40, 41, 42 and 43 where they are transferred onto a sheet 78 of support material, such as plain paper or a transparent film. At a transfer station, a sheet follows the rectilinear sheet path 17 into contact with endless photoconductor belt 26. The sheet is advanced in synchronism with the movement of the endless photoconductor belt. The difference between the spacing between two adjacent transfer stations 40, 41, 42, 43, as measured along the belt path 58, and the spacing between two adjacent transfer stations 40, 41, 42, 43, as measured along the paper path, is equal to the distance (D) between two successive color planes on the belt, i.e. 545.82 mm.

After transfer of the four toner images, the endless photoconductor belt following an upward course is cleaned in a cleaning station 45 where a rotatable fibrous brush or the like is maintained in contact with the photoconductor belt 26 to remove residual toner particles remaining after the transfer operation. Thereafter, an erasing lamp 46 illuminates the endless photoconductor belt to remove any residual charge remaining thereon prior to the start of the next cycle.

The operation of the printer described hereinbefore is as follows.

The magenta latent image being exposed by station 29 on endless photoconductor belt 26, this image is progressively developed by station 35 being in its operative position as the endless photoconductor belt moves there-through. Upon completion of the exposure of the magenta image, the yellow image becomes exposed. During the yellow exposure, the developed magenta image is transported past inactive stations 36, 37 and 38 while toner transfer stations 40 to 43 are also still inoperative.

As the development of the magenta latent image is finished, magenta development station 35 is withdrawn to its inoperative position and after the trailing edge of the magenta image has passed yellow development station 36, this station is put into the operative position to start the development of the yellow latent image. While the latter portion of the yellow latent image is being developed, the exposure of the cyan latent image at exposure station 29 starts already.

The control device 50 acts in response to signals fed from the drive motor encoder 57 to ensure that the drive motor 56 is driven at a constant speed while electrostatic images are formed on the belt 26.

The described processes of image-wise exposure and color development continue until the four color separation images have been formed in successive spaced relationship on the endless photoconductor belt.

A sheet 78 which has been taken from stack 12 and kept in readiness in aligner 16, is then advanced and reaches toner transfer station 40 where at that moment the last formed toner image, viz. the black one, is ready to enter the station. Thus, the lastly formed toner image is the first to become transferred to a sheet. The firstly formed toner image, viz. the magenta one, takes with its leading edge a position on the endless photoconductor belt as indicated by the cross 62 and will thus be transferred last. The other two toner images take positions with their leading edges as indicated by crosses 63 and 64, respectively.

Thus, the timing of exposure of the four distinct images, the relative position of these images on the endless photoconductor belt and the lengths of the path of this endless photoconductor belt between the successive transfer stations are such that as a paper sheet follows a linear path through these stations, the partly simultaneous transfer of the distinct toner images to the paper sheet is such that a perfect registering of these images is obtained.

The sheet bearing a color toner image on its obverse side produced as described hereinbefore, is now passed through a similarly constructed second image-forming section 21 for applying a color toner image to the reverse side of the sheet. Referring to the second image-forming section 21, there is shown an endless photoconductor belt 60, which is driven by a controllable belt drive motor 73 associated with an encoder 77, the signal generated by the encoder 77 being fed to the control device 50. The endless photoconductor belt 60 is driven along a belt path 74 past an imaging station 61 at which four electrostatic images are sequentially formed on the endless photoconductor belt 60, four developing stations 65, 66, 67, 68 at which the electrostatic images formed by the imaging station 61 are developed into toner images on the endless photoconductor belt 60, and four transfer stations 69, 70, 71, 72 at which the toner images are transferred to the substrate.

The endless photoconductor belt 60 is driven along the belt path 74 through an imaging station 61, four developing stations 65, 66, 67, 68 and four transfer stations 69, 70, 71, 72.

Four electrostatic images are sequentially formed on the endless photoconductor belt 60 at the imaging station 61. The endless photoconductor belt 60 is nominally divided into seven regions, the seam of the belt being positioned between two adjacent regions. The formation of the four electrostatic images is so controlled as to locate each electrostatic image in a respective region of the endless photoconductor belt 60.

The electrostatic images are developed into toner images on the endless photoconductor belt 60 at the developing stations 65, 66, 67, 68.

The control device 50 acts in response to signals fed from the drive motor encoder 77 to ensure that the drive motor 73 is driven at a constant speed while electrostatic images are formed on the belt 60.

A preformed timing mark in the form of a hole 44 is carried on the endless photoconductor belt 26, outside the image area (i.e. in one or both margins) and close to the seam 52. A similar preformed timing mark 55 is carried on the second endless photoconductor belt 60, in a similar position. A sensor 49 is provided for sensing the passage of the timing mark 44 past a sensing position 48 for the first belt. Similarly, a sensor 51 is provided for sensing the passage of the timing mark 55 past a sensing position 53.

The control device 50, receives signals from the sensor 49 and, in response thereto, controls the speed of the endless photoconductor belt 26 by changing the set point of the feedback loop which controls the speed of the drive roller 85. The control device 50 receives signals from the sensor 51. In response thereto, the control device 50 controls the speed of the second endless photoconductor belt 60 by changing the set point of the feedback loop which controls the speed of the drive roller 86 to the average speed of the first belt 26 as calculated by the control device 50. The timing marks carried on the two endless belts 26, 60 are sensed as they pass the sensing positions 48, 53. The speed of both endless belts 26, 60 and the speed of the paper sheet 78 through the transfer stations 40, 41, 42, 43, and 69, 70, 71, 72 are controlled in response to the sensing of the timing marks. In other words, the driving speed of both belts is kept constant by measuring the belt revolution time and adjusting the speed of the first belt 26 so that the belt revolution time of the second belt is equal to the belt revolution time of the first belt. In this manner, a belt speed accuracy of 0.01% can be achieved.

The buffer station 23 with an endless belt 24 transports the sheet bearing the color images to the fuser station 25. The buffer station 23 allows the speed of the sheet to change, thereby enabling the speed of fuser station 25 to be different from that of the speed of image-forming stations 20, 21. In the apparatus according to the present embodiment, the speed of the two endless photoconductor belts may be, for example, 125 or 250 mm/s, whereas the fusing speed may be 100 mm/s or less. The length of the buffer station 23 is sufficient for receiving the largest sheet size to be processed in the apparatus. Buffer station 23 operates initially at the speed of the endless photoconductor belts 26, 60 of image-forming stations 20 and 21. The speed of the buffer station is reduced to the processing speed of the fuser station 25 as the trailing edge of the sheet 78 leaves the second image-forming section 21.

The fuser station 25 operates to melt the toner particles transferred to the sheets in order to affix them. The fusing station 25 can be of known construction, and can be arranged for radiation or flash fusing, or for fusing by convection and/or by pressure. Hot fusing is preferred. The fused sheet is finally received on platform 14.

We claim:

1. An image-forming apparatus for forming multiple toner images in register with each other on a substrate in sheet form, said apparatus comprising:

an endless belt;

an imaging station at which a plurality of electrostatic images are sequentially formed on said belt;

plurality of developing stations at which said electrostatic images are developed into toner images on said belt;

a plurality of transfer stations at which said toner images are transferred to a substrate;

a belt drive device for driving said endless belt along a belt path through said imaging station, said developing stations and said transfer stations; and a control device for controlling said belt drive device to run at a constant speed, characterized by:

a preformed timing mark carried on said belt; and a sensor for sensing passage of said timing mark past a sensing position, and wherein said control device is adapted to control the speed of said belt in response to sensing of said timing mark such that the time interval between two successive sensings of said timing mark is kept constant.

2. An apparatus according to claim 1, further comprising a substrate drive device for driving said substrate along a substrate path into synchronous contact with said endless belt at an initial one of said transfer stations, said control device being adapted to control the speed of said substrate through said transfer stations in response to sensing of said timing mark.

3. An apparatus according to claim 1, wherein said belt includes a transverse seam, and said timing mark is located at a predetermined position relative to said seam.

4. An apparatus according to claim 1, wherein said endless belt passes over at least one guide roller, having a circumference which is an integral factor of the total length of said belt.

5. An image-forming apparatus for forming multiple toner images in register with each other on both faces of a substrate in sheet form, said apparatus comprising:

a first endless belt;

a first imaging station at which a plurality of first electrostatic images are sequentially formed on said first belt;

a plurality of first developing stations at which said first electrostatic images are developed into first toner images on said first belt;

a plurality of first transfer stations at which said first toner images are transferred to one face of a substrate;

a first belt drive device for driving said first endless belt along a first belt path through said first imaging station, said first developing stations and said first transfer stations;

a second endless belt;

a second imaging station at which a plurality of second electrostatic images are sequentially formed on said second belt;

a plurality of second developing stations at which said second electrostatic images are developed into second toner images on said second belt;

a plurality of second transfer stations at which said second toner images are transferred to the opposite face of said substrate;

a second belt drive device for driving said second endless belt along a second belt path through said second imaging station, said second developing stations and said second transfer stations; and a control device for controlling said first belt drive device and said second belt drive device each to run at a constant speed, characterized by:

a preformed timing mark carried on said first belt; and a sensor for sensing passage of said timing mark past a sensing position, and wherein said control device is adapted to control the speed of said first and second belts in response to sensing of said timing mark.

6. An apparatus according to claim 5, further comprising a second preformed timing mark carried on said second belt, a second sensor for sensing passage of said second timing mark past a second sensing position, said control device being additionally adapted to control the speed of said second belt in response to sensing of said second timing mark.

7. A method of operating an image-forming apparatus to form multiple toner images in register with each other on a substrate in sheet form, said method comprising driving an endless belt along a belt path through an imaging station, a plurality of developing stations and a plurality of transfer stations;

sequentially forming a plurality of electrostatic images on said belt at said imaging station;

controlling a belt drive device for said belt to run at a constant speed while said images are being formed on said belt at said imaging station;

developing said electrostatic images into toner images on said belt at said plurality of developing stations; and transferring said toner images to a substrate at said plurality of transfer stations, characterized by:

sensing a preformed timing mark carried on said belt, as said timing mark passes a sensing position; and controlling the speed of said belt in response to sensing of said timing mark such that the time interval between two successive sensings of the timing mark is kept constant.

8. A method according to claim 7, further comprising driving said substrate in sheet form along a substrate path into synchronous contact with said endless belt at said transfer stations and controlling the speed of said substrate through said transfer stations in response to sensing of said timing mark.

9. A method according to claim 7, wherein control of the speed of said belt is achieved by a correction applied:

(i) at start up of said apparatus;

(ii) after predetermined periods of run time of said apparatus; and/or (iii) after each revolution of said belt.

10. A method according to claim 7, wherein said belt is nominally divided into a plurality of regions, wherein formation of said plurality of electrostatic images is so controlled as to locate each electrostatic image in a respective region of said belt.

11. A method according to claim 10, wherein said belt includes a transverse seam, said timing mark is located at a predetermined position relative to said seam, and said seam being positioned between two adjacent regions.

12. A method of operating an image-forming apparatus to form multiple toner images in register with each other on both faces of a substrate in sheet form, said method comprising:

driving a first endless belt along a first belt path through a first imaging station, a plurality of first developing stations and a plurality of first transfer stations;

sequentially forming a plurality of first electrostatic images on said first belt at said first imaging station;

controlling a first belt drive device for said first belt to run at a constant speed while said first images are being formed on said first belt at said first imaging station;

developing said first electrostatic images into first toner images on said first belt at said plurality of first developing stations;

transferring said first toner images to one face of a substrate at said plurality of first transfer stations;

driving a second endless belt along a second belt path through a second imaging station, a plurality of second developing stations and a plurality of second transfer stations;

sequentially forming a plurality of second electrostatic images on said second belt at said second imaging station;

controlling a second belt drive device for said second belt to run at a constant speed while said second images are being formed on said second belt at said second imaging station;

developing said second electrostatic images into second toner images on said second belt at said plurality of second developing stations; and transferring said second toner images to the opposite face of said substrate at said plurality of second transfer stations;

characterized by:

sensing a first performed timing mark carried on said first belt, as said timing mark passes a first sensing position, thereby to determine a measured speed for said first belt;

controlling the speed of said first belt in response to sensing of said timing mark such that the time interval between two successive sensings of the first timing mark is kept constant;

sensing a second preformed timing mark carried on said second belt, as said second timing mark passes a second sensing position; and controlling the speed of said second belt in response to sensing of said second timing mark.

13. A method according to claim 12, wherein the speed of said second belt is controlled in response to sensing of said second timing mark to a target value equal to said measured speed of said first belt.

14. A method according to claim 12, wherein the speed of one of said belts is controlled in response to sensing of its associated timing mark to a value equal to the measured speed of the other of said belts.

* * * * *